US012442384B2

(12) United States Patent
Noguchi et al.

(10) Patent No.: US 12,442,384 B2
(45) Date of Patent: Oct. 14, 2025

(54) VEHICLE COMPRESSOR COMPONENT AND METHOD FOR MANUFACTURING THE SAME

(71) Applicant: KABUSHIKI KAISHA TOYOTA JIDOSHOKKI, Aichi (JP)

(72) Inventors: Masato Noguchi, Aichi (JP); Tomohei Sugiyama, Aichi (JP); Yasuo Kotetsu, Aichi (JP); Takuya Arayama, Fukushima (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 378 days.

(21) Appl. No.: 18/031,062

(22) PCT Filed: Jul. 14, 2021

(86) PCT No.: PCT/JP2021/026491
§ 371 (c)(1),
(2) Date: Apr. 10, 2023

(87) PCT Pub. No.: WO2022/079964
PCT Pub. Date: Apr. 21, 2022

(65) Prior Publication Data

US 2023/0374996 A1 Nov. 23, 2023

(30) Foreign Application Priority Data

Oct. 12, 2020 (JP) ..... 2020-171791

(51) Int. Cl.

| | |
|---|---|
| ***C22C 21/06*** | (2006.01) |
| ***B22F 3/20*** | (2006.01) |
| ***C22C 1/04*** | (2023.01) |
| ***F04D 29/02*** | (2006.01) |

(52) U.S. Cl.
CPC ..... *F04D 29/023* (2013.01); *B22F 3/20* (2013.01); *C22C 1/0416* (2013.01); *C22C 21/06* (2013.01);
(Continued)

(58) Field of Classification Search
None
See application file for complete search history.

(56) References Cited

U.S. PATENT DOCUMENTS 5,338,168 A * 8/1994 Kondoh ..... C22C 1/0416 418/179
5,902,546 A * 5/1999 Kawasetsu ..... C22C 1/0416 148/692
(Continued)

FOREIGN PATENT DOCUMENTS

CN 109852833 A 6/2019
CN 111065754 A 4/2020
(Continued)

OTHER PUBLICATIONS

Office Action that issued in the corresponding Chinese Patent Appl. No. 202180069095.0 dated Apr. 25, 2025, along with English translation thereof.
(Continued)

*Primary Examiner* — Christopher S Kessler
(74) *Attorney, Agent, or Firm* — GREENBLUM & BERNSTEIN, P.L.C.

(57) ABSTRACT

A vehicle compressor component includes an aluminum alloy material made by hot-extruding. The aluminum alloy material has a chemical composition consisting of Fe: 5.0% to 9.0% by mass, Mg: 0.7% to 3.0% by mass, V: 0.1% to 3.0% by mass, Mo: 0.1% to 3.0% by mass, Zr: 0.1% to 2.0% by mass, Ti: 0.02% to 2.0% by mass, and balance Al and unavoidable impurities. The aluminum alloy material has a
(Continued)

density of 2.96 g/cm$^3$ or more. A method for manufacturing the vehicle compressor component includes: compacting aluminum alloy powders having the chemical composition to prepare a compact; hot-extruding the compact to make an aluminum alloy material; and forming the aluminum alloy material into a desired shape.

2 Claims, 2 Drawing Sheets

(52) U.S. Cl.
CPC .... *B22F 2003/208* (2013.01); *C22C 2202/00* (2013.01)

(56) References Cited

U.S. PATENT DOCUMENTS

2012/0144824 A1* 6/2012 Schall ..... F02C 6/12 416/223 R
2016/0138400 A1* 5/2016 Karabin ..... F04D 29/023 420/537
2017/0292174 A1* 10/2017 Karabin ..... B22F 10/34
2019/0100824 A1* 4/2019 Arayama ..... B22F 3/20
2019/0299296 A1* 10/2019 Arayama ..... B22F 3/20
2020/0238385 A1* 7/2020 Kotetsu ..... B22F 3/20
2023/0374996 A1* 11/2023 Noguchi ..... C22C 1/0416

FOREIGN PATENT DOCUMENTS

JP 2008-189995 A 8/2008
JP 5284935 B2 6/2013

OTHER PUBLICATIONS

International Search Report and Written Opinion of the International Searching Authority issued in International Patent Application No. PCT/JP2021/026491, mailed Sep. 21, 2021, along with an English translation thereof.

* cited by examiner

VEHICLE COMPRESSOR COMPONENT AND METHOD FOR MANUFACTURING THE SAME

CROSS-REFERENCE TO RELATED APPLICATIONS

This application is a National Stage of International Application No. PCT/JP2021/026491 Jul. 14, 2021, claiming priority based on Japanese Patent Application No. 2020-171791 filed Oct. 12, 2020, the contents of all of which are incorporated herein by reference in their entirety.

TECHNICAL FIELD

The present disclosure relates to a vehicle compressor component and a method for manufacturing the same.

BACKGROUND ART

A vehicle, such as an automobile, may include a compressor, such as a turbocharger. Such a compressor operates at a temperature of about 150° C., and therefore needs to have excellent mechanical properties at a high temperature. Particularly, a rotary component of the compressor, such as an impeller, needs to have excellent stiffness at a high temperature, and further have strength needed for rotating at a high speed because the rotary component rotates at a high speed exceeding 10,000 rpm during operation of the compressor.

As an example of an aluminum alloy material used for the compressor component, Patent literature 1 describes a heat-resistance aluminum-alloy extruded material that consists of copper (Cu): 3.4% to 5.5% (% by mass, the same applies hereinafter), magnesium (Mg): 1.7% to 2.3%, nickel (Ni): 1.0% to 2.5%, iron (Fe): 0.5% to 1.5%, manganese (Mn): 0.1% to 0.4%, zirconium (Zr): 0.05% to 0.3%, silicon (Si): less than 0.1%, titanium (Ti): less than 0.1%, and balance aluminum (Al) and unavoidable impurities, and has excellent high-temperature strength and high-temperature fatigue property.

However, such an aluminum alloy material, like the aluminum alloy material of Patent literature 1, which is obtained by smelting, specifically, by casting melted aluminum alloy having a desired chemical composition, is limited in range of available chemical composition. Therefore, in recent years, it is considered that an aluminum alloy material for a compressor component is made by powder metallurgical process, specifically, by using aluminum alloy powders having a desired chemical composition.

CITATION LIST

Patent Literature

Patent Literature 1: Japanese Patent No. 5284935

SUMMARY OF INVENTION

Technical Problem

Accordingly, a method for making an aluminum alloy material using powder metallurgical process includes a step for compacting aluminum alloy powders having a desired chemical composition to prepare a compact and a step for hot-extruding the compact, for example. However, the aluminum alloy is relatively easily oxidized by oxygen and the like in the atmosphere. This forms an oxide film on the surface of each of aluminum alloy particles forming the aluminum alloy powders.

The presence of the oxide film on the surface of the aluminum alloy particle causes a region in which binding of the particles is insufficient to be formed in an obtained aluminum alloy material, thereby causing a decrease in elongation of the aluminum alloy material or in fatigue property of the aluminum alloy material. Particularly in the aluminum alloy material obtained by powder metallurgical process, elongation or fatigue property in the direction perpendicular to the extrusion direction is likely to become lower than elongation or fatigue property in the direction parallel to the protruding direction.

The present disclosure, which has been made in light of the above-mentioned problem, is directed to providing a vehicle compressor component having excellent elongation and fatigue property and a method for manufacturing the same.

Solution to Problem

An aspect of the present disclosure is a vehicle compressor component that includes an aluminum alloy material made by hot-extruding, wherein the aluminum alloy material has a chemical composition consisting of iron (Fe): 5.0% to 9.0% by mass, magnesium (Mg): 0.7% to 3.0% by mass, vanadium (V): 0.1% to 3.0% by mass, molybdenum (Mo): 0.1% to 3.0% by mass, zirconium (Zr): 0.1% to 2.0% by mass, titanium (Ti): 0.02% to 2.0% by mass, and balance aluminum (Al) and unavoidable impurities, and the aluminum alloy material has a density of 2.96 g/cm$^3$ or more.

Another aspect of the present disclosure is a method for manufacturing the vehicle compressor component of the aspect, the method comprising: compacting aluminum alloy powders having the chemical composition to prepare a compact; hot-extruding the compact to make an aluminum alloy material; and forming the aluminum alloy material into a desired shape.

Advantageous Effect of Invention

The vehicle compressor component (hereinafter referred to as "compressor component") includes the aluminum alloy material having the aforementioned special chemical composition and density. The aluminum alloy material having the chemical composition and the density within the aforementioned special range provides sufficient binding of aluminum alloy particles in the manufacturing process of the aluminum alloy material. Accordingly, the compressor component including the aluminum alloy material has excellent elongation and fatigue property.

The aluminum alloy powders used by the method for manufacturing the compressor component contains Mg. Mg contained in the aluminum alloy powders has an action to break a film made of oxide of aluminum. Using the aluminum alloy powders having the special chemical composition may, in the manufacturing process of the aluminum alloy material, allow further easier binding of the aluminum alloy particles forming the aluminum alloy powders. This therefore easily provides the aluminum alloy material in which the binding of the aluminum alloy particles is sufficient. Accordingly, manufacturing the compressor component using this aluminum alloy material easily provides the compressor component having excellent elongation and fatigue property.

The aforementioned aspects are directed to providing a vehicle compressor component having excellent elongation and fatigue property and a method for manufacturing the same.

DESCRIPTION OF EMBODIMENTS (Vehicle Compressor Component)

Figure 1:
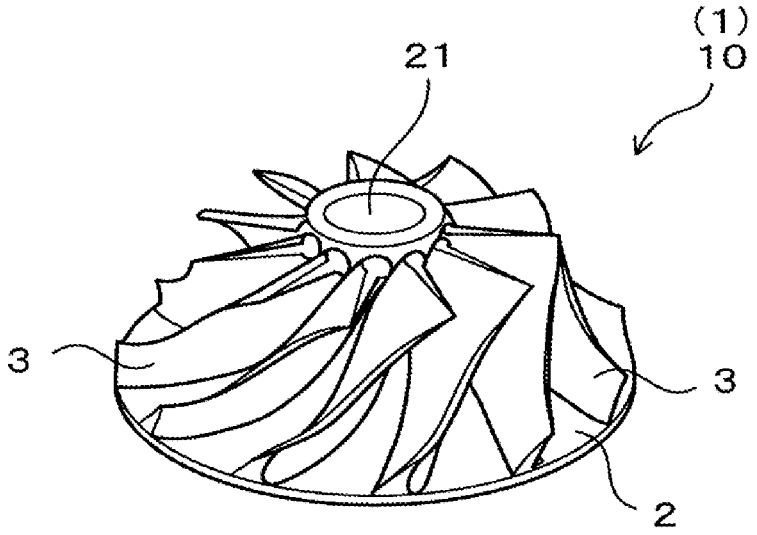
FIG. 1 is a perspective view of a vehicle compressor component according to an embodiment.

The following will describe a chemical composition, a metallic structure, and mechanical properties of an aluminum alloy material for a compressor component.

Iron (Fe): 5.0% to 9.0% by Mass

The aluminum alloy material for the compressor component contains Fe of 5.0% to 9.0% by mass. Setting Fe content in the aluminum alloy material within the aforementioned special range allows Al—Fe intermetallic compounds having a high melting point and stable at a high temperature to be formed in the aluminum alloy material. This therefore allows an increase in mechanical properties of the compressor component at a high temperature, such as static strength and creep resistance within a temperature range from 200° C. to 350° C.

Fe content in the aluminum alloy material less than 5.0% by mass may decrease the strength of the compressor component. On the other hand, Fe content in the aluminum alloy material more than 9.0% by mass may decrease the ductility of the compressor component. To increase the strength and the ductility of the compressor component in the right equilibrium, Fe content in the aluminum alloy material is preferably from 7.0% to 8.0% by mass.

Magnesium (Mg): 0.7% to 3.0% by Mass

The aluminum alloy material for the compressor component contains Mg of 0.7% to 3.0% by mass. Setting Mg content in the aluminum alloy material within the aforementioned special range may, in the manufacturing process of the aluminum alloy material, facilitate breakdown of the oxide film on the surface of the aluminum alloy particle, thereby allowing the aluminum alloy particles to be easily bound to each other. This therefore allows an increase in elongation and fatigue property of the compressor component.

Mg content in the aluminum alloy material less than 0.7% by mass may cause a part in which binding of the aluminum alloy particles is insufficient to be formed in the aluminum alloy material. This may cause a decrease in elongation or fatigue property of the compressor component. On the other hand, Mg content in the aluminum alloy material more than 3.0% by mass may promote oxidization of the surface of the aluminum particle in the manufacturing process of the aluminum alloy material. This may allow a part in which binding of the aluminum alloy particles is insufficient to be formed in the aluminum alloy material, and therefore may cause a decrease in elongation or fatigue property of the compressor component.

To further enhance the action effect of Mg, Mg content in the aluminum alloy material is preferably from 0.7% to 2.5% by mass, more preferably from 0.8% to 2.0% by mass, most preferably from 0.9% to 1.5% by mass.

Vanadium (V): 0.1% to 3.0% by Mass

The aluminum alloy material for the compressor component contains V of 0.1% to 3.0% by mass. Setting V content in the aluminum alloy material within the aforementioned special range allows Al—Fe—V—Mo intermetallic compounds as Al—Fe intermetallic compounds to be formed in the aluminum alloy material. This therefore allows an increase in mechanical properties of the compressor component at a high temperature, such as static strength and creep resistance at a temperature of 200° C. to 350° C.

V content in the aluminum alloy material less than 0.1% by mass may decrease the strength of the compressor component. On the other hand, V content in the aluminum alloy material more than 3.0% by mass may decrease the ductility of the compressor component. To increase the strength and the ductility of the compressor component in the right equilibrium, V content in the aluminum alloy material is preferably from 1.0% to 2.0% by mass.

Molybdenum (Mo): 0.1% to 3.0% by Mass

The aluminum alloy material for the compressor component contains Mo of 0.1% to 3.0% by mass. Setting Mo content in the aluminum alloy material within the aforementioned special range allows Al—Fe—V—Mo intermetallic compounds as Al—Fe intermetallic compounds to be formed in the aluminum alloy material. This therefore allows an increase in mechanical properties of the compressor component at a high temperature, such as static strength and creep resistance at a temperature of 200° C. to 350° C.

Mo content in the aluminum alloy material less than 0.1% by mass may decrease the strength of the compressor component. On the other hand, Mo content in the aluminum alloy material more than 3.0% by mass may decrease the ductility of the compressor component. To increase the strength and the ductility of the compressor component in the right equilibrium, Mo content in the aluminum alloy material is preferably from 1.0% to 2.0% by mass.

Zirconium (Zr): 0.1% to 2.0% by Mass

The aluminum alloy material for the compressor component contains Zr of 0.1% to 2.0% by mass. Zr has an action to refine the Al—Fe intermetallic compounds formed in the aluminum alloy material. Zr further has an action to reduce self-diffusion of Al in Al matrix so as to increase the creep resistance. Setting Zr content in the aluminum alloy material within the aforementioned special range allows Al—Fe intermetallic compounds to be finely precipitated in the aluminum alloy material to further increase effects of precipitation strengthening and dispersion strengthening of Al—Fe intermetallic compounds. Setting Zr content in the aluminum alloy material within the aforementioned special range allows a further increase in the creep resistance of the compressor component.

Zr content in the aluminum alloy material less than 0.1% by mass may decrease the effects of precipitation strengthening and dispersion strengthening. On the other hand, Zr content in the aluminum alloy material more than 2.0% by mass may allow coarse intermetallic compounds containing Zr to be formed in the aluminum alloy material, thereby causing a decrease in mechanical properties. To prevent the formulation of the coarse intermetallic compounds and increase the action effect of Zr, Zr content in the aluminum alloy material is preferably from 0.5% to 1.5% by mass.

Titanium (Ti): 0.02% to 2.0% by Mass

The aluminum alloy material for the compressor component contains Ti of 0.02% to 2.0% by mass. The presence of Ti together with Zr in the aluminum alloy material allows Al—(Ti, Zr) intermetallic compounds having L12 structure to be formed in Al matrix. Setting Ti content in the aluminum alloy material within the aforementioned special range achieves effects of precipitation strengthening and dispersion strengthening of Al—(Tl, Zr) intermetallic compounds. Further, setting Ti content in the aluminum alloy material within the aforementioned special range allows an increase in the creep resistance of the compressor component because Ti has a small diffusion coefficient in Al matrix.

Ti content less than 0.02% by mass in the aluminum alloy material may decrease the effects of precipitation strengthening and dispersion strengthening of Al—(Tl, Zr) intermetallic compounds. On the other hand, Ti content in the aluminum alloy material more than 2.0% by mass may decrease the ductility of the compressor component. To increase the strength and the ductility of the compressor component in the right equilibrium, Ti content in the aluminum alloy material is preferably from 0.5% to 1.0% by mass.

Boron (B): 0.0001% to 0.03% by Mass

The aluminum alloy material for the compressor component contains B: 0.0001% to 0.03% by mass as an optional ingredient. This allows further refining of crystal grains in the aluminum alloy material. This therefore allows a further increase in mechanical properties of the compressor component.

Metallic Structure

The aluminum alloy material for the compressor component may have a metallic structure in which Al—Fe intermetallic compounds as secondary-phase particles are dispersed in the Al parent phase. The Al—Fe intermetallic compounds mean intermetallic compounds containing Al and Fe. The Al—Fe intermetallic compounds may be binary compounds consisting of Al and Fe, or ternary or more compounds containing other elements, such as V and Mo, in addition to Al and Fe, for example.

The mean equivalent circular diameter of Al—Fe intermetallic compounds in the aluminum alloy material is preferably from 0.1 μm to 3.0 μm. This increases the effects of precipitation strengthening and dispersion strengthening of Al—Fe intermetallic compounds. This therefore allows a further increase in mechanical properties of the compressor component. To promote a further increase in mechanical properties of the compressor component, the mean equivalent circular diameter of Al—Fe intermetallic compounds is more preferably from 0.3 μm to 2.0 μm, and more preferably 0.4 μm to 1.5 μm.

The following will describe a method for calculating the mean equivalent circular diameter of Al—Fe intermetallic compounds in the aluminum alloy material in detail. Firstly, a specimen, which has a cube shape with 10 mm on a side and has six surfaces in which a pair of surfaces is perpendicular to the extruding direction, is taken from the center portion of the compressor component. The surfaces of the specimen are polished by a device to prepare a cross section of a specimen (e.g., CROSS SECTION POLISHER™), and observed by a scanning electron microscope (SEM) to obtain SEM images. In the SEM observation, an area of field of view, a position of observation, and the number of SEM images are not particularly limited.

Then, the equivalent circular diameter of each of the Al—Fe intermetallic compounds appeared in the SEM images is determined by calculating the diameter of a circle having an area equivalent to the area of each Al—Fe intermetallic compound in the SEM images. The arithmetic mean value of the equivalent circular diameters of the Al—Fe intermetallic compounds obtained in such a manner is determined as the mean equivalent circular diameter of the Al—Fe intermetallic compounds in the aluminum alloy material. Accurate calculation of the mean equivalent circular diameter preferably requires the sufficient number of Al—Fe intermetallic compounds. Specifically, the mean equivalent circular diameter of the Al—Fe intermetallic compounds of the aluminum alloy material is determined preferably by calculating the arithmetic mean value of the equivalent circular diameters of 10 or more Al—Fe intermetallic compounds, for example.

The compressor component includes an aluminum alloy material at least made by hot-extruding. Whether or not the aluminum alloy material of the compressor component is made by hot-extruding may be determined by the presence of a striated pattern extending along the extrusion direction in various cross sections of the compressor component, for example.

Further, the compressor component preferably includes an aluminum alloy material made by powder metallurgical process, specifically, by hot-working a compact prepared from aluminum alloy powders having the aforementioned special chemical composition. Whether or not the aluminum alloy material of the compressor component is made by powder metallurgical process may be determined by a mean grain diameter in the observation of various cross sections of the compressor component, for example. Specifically, if the mean grain diameter observed in arbitrary cross section of the compressor component is 3 μm or less, it may be determined that the aluminum alloy material of the compressor component is made by powder metallurgical process.

The aluminum alloy material for the compressor component may have voids formed in the manufacturing process. For example, the aluminum alloy material for the compressor component made by powder metallurgical process may have voids resulting from gaps between the aluminum alloy powders.

In the process for making the aluminum alloy material by powder metallurgical process, the compact formed of the aluminum alloy powders is extended by hot-extruding in the extrusion direction, so that the size of the compact is reduced in the radial direction, i.e., the direction perpendicular to the extrusion direction. The size of each void within the compact is extended in the extrusion direction by metal flow during hot-extruding and therefore reduced in the radial direction. Accordingly, the compressor component including an aluminum alloy material made by powder metallurgical process may have a long thin void extending in the extrusion direction.

The equivalent circular diameter of the void observed in the section of the aluminum alloy material parallel to the extrusion direction is preferably 400 μm or less, more preferably 300 μm or less, and more preferably 200 μm or less. Setting the equivalent circular diameter of the void observed in the section of the aluminum alloy material parallel to the extrusion direction within the aforementioned special range allows an increase in mechanical properties of the aluminum alloy material in the direction perpendicular to the extrusion direction and a decrease in the difference between mechanical properties of the aluminum alloy material in the direction perpendicular to the extrusion direction and mechanical properties of the aluminum alloy material in the direction parallel to the extrusion direction. Accordingly, manufacturing the compressor component using this aluminum alloy material allows an increase in mechanical properties of the compressor component.

It may be considered that the action effects are achieved by the following reasons, for example. If stress is applied to the compressor component, smaller section area of the void observed in the section of the compressor component perpendicular to the direction of stress may more reduce cracking or the like, which may occur from the void. However, in the aluminum alloy material made by hot-extruding, metal flow during hot-extruding is likely to extend the void within the aluminum alloy material in the extrusion direction. Accordingly, the section area of the void observed in the section parallel to the extrusion direction is considered to be likely to become larger than the section area of the void observed in the section perpendicular to the extrusion direction.

In this regard, setting the equivalent circular diameter of the void observed in the section parallel to the extrusion direction, i.e., the section in which the void has the largest section area, within the aforementioned special range may efficiently reduce cracking in the section parallel to the extrusion direction. This is considered to therefore allow a decrease in the difference between mechanical properties of the compressor component in the direction parallel to the extrusion direction and mechanical properties of the compressor component in the direction perpendicular to the extrusion direction even if the compressor component has voids.

The equivalent circular diameter of each of the voids within the compressor component is calculated as follows, for example. Firstly, a specimen is taken from the compressor component by the same method as the method for calculating the mean equivalent circular diameter of Al—Fe intermetallic compounds. Then, surfaces of the specimen parallel to the extrusion direction are observed by the SEM to obtain SEM images.

The equivalent circular diameter of each of voids appeared in the SEM images is determined by calculating the diameter of a circle having an area equivalent to the area of each void in the SEM images. Although, in the SEM observation, an area of field of view, a position of observation, and the number of SEM images are not particularly limited, the sufficient number of voids are preferably appeared in the SEM images for accurate calculation of the maximum value of equivalent circular diameters of the voids. Specifically, the SEM images are preferably obtained such that the total area of field of view of the SEM images is 1 $mm^2$ or more.

The surface hardness of the aluminum alloy material for the compressor component is preferably 140 HV or more, and more preferably 150 HV or more. This allows an increase in durability of the compressor component. The surface hardness of the aluminum alloy material is expressed in Vickers hardness of the surface of the compressor component measured by a Vickers hardness tester.

The specific fatigue strength of the aluminum alloy material in the direction perpendicular to the extrusion direction is preferably 45 MPa/(g/$cm^3$) or more, and more preferably 50 MPa/(g/$cm^3$) or more. This allows a further increase in mechanical properties of the compressor component. The specific fatigue strength is obtained by dividing the fatigue strength of the aluminum alloy material at ambient temperature by the density of the aluminum alloy material. The fatigue strength of the aluminum alloy material is a completely reversed tension and compression fatigue limit value $\sigma w$ obtained by tension and compression fatigue testing in accordance with JIS Z2273: 1978.

The detailed test conditions for the tension and compression fatigue testing are as follows.

Cycle period: 40 Hz

Number of cycles during fatigue testing n: 1×107 cycles

Shape of specimen: a dumbbell specimen shaped with a 7 mm gauge length and a 4 mm parallel section diameter, taken from the compressor component such that the longitudinal direction of the specimen is perpendicular to the extrusion direction The elongation of the aluminum alloy material in the direction perpendicular to the extrusion direction is preferably 1% or more, and more preferably 2% or more. This allows a further increase in mechanical properties of the compressor component, thereby increasing the durability of the compressor component. The elongation of the aluminum alloy material is an elongation value after fracture obtained by tension testing specified in JIS Z2241: 2011 at ambient temperature.

The compressor component may be an impeller of a compressor such as a turbocharger, for example. As described above, the compressor component allows an increase in mechanical properties in the direction perpendicular to the extrusion direction, thereby allowing a decrease in the difference between mechanical properties of the compressor component in the direction parallel to the extrusion direction and mechanical properties of the compressor component in the direction parallel to the extrusion direction. Accordingly, the aluminum alloy material is suitable for a rotating member, such as an impeller, subjected to a centrifugal force due to high-speed rotation.

(Method for Manufacturing Vehicle Compressor Component)

The compressor component may be manufactured from the aluminum alloy material made by powder metallurgical process. For example, the compressor component may be manufactured by a method including:

compacting aluminum alloy powders having the chemical composition to prepare a compact;

hot-extruding the compact to make an extruded material; and forming the extruded material into a desired shape.

Preparation of Compact

In this method, firstly, a compact is prepared by compacting aluminum alloy powders having the aforementioned special chemical composition. The mean particle diameter of the aluminum alloy powders for the compact is preferably from 30 μm to 70 μm.

The aluminum alloy powders may be produced by atomization, for example. In atomization, fine drops of melted aluminum alloy are prepared by blowing gas, such as nitrogen gas, on the melted aluminum alloy having the chemical composition, and the fine drops are rapidly cooled and solidified to obtain aluminum alloy powders. The rate for cooling the fine drops ranges from 102° C. per second to 105° C. per second, for example.

Specifically, the compact is prepared as follows, for example. Firstly, the aluminum alloy powders are heated to a temperature of 250° C. to 300° C., and filled into a mold having a temperature of 230° C. to 270° C. Next, the aluminum alloy powders in the mold are compressed, for example, at a pressure of 0.5 tf/$cm^2$ to 3.0 tf/$cm^2$ (i.e., 49 MPa to 290 Mpa), to prepare a compact. The mold may have any shape, but preferably has a shape suitable for preparing a compact having a solid cylindrical shape or disc shape in terms of workability or the like in the extruding step. The relative density of the compact is preferably from 60% to 90%.

Hot-Extruding

In the method for manufacturing the compressor component, aluminum alloy powders are compacted to prepare a compact, and the compact is hot-extruded to make an aluminum alloy material. The compact to be hot-extruded may be prepared just by compacting aluminum alloy powders, or may be prepared by machining, such as facing, the compact prepared by compacting aluminum alloy powders.

To make the aluminum alloy material, firstly, the compact is degassed. Next, the compact preliminarily heated to a temperature of 300° C. to 450° C. is placed in a container having a temperature of 300° C. to 400° C. Then, the compact in the container is pressurized and extruded from a die by a ram. The extrusion pressure for extruding may be appropriately set within a range of 10 MPa to 25 MPa. The aluminum alloy material may have a solid cylindrical shape, for example.

Shape Forming of Aluminum Alloy Material

The compressor component is obtained by forming the aluminum alloy material made by hot-extruding into a desired shape. The machining method for aluminum alloy material is not particularly limited, and may be selected, according to a desired shape of the compressor component, from any machining methods, such as lathe machining, cutting machining, and the like.

Embodiment

The following will describe an embodiment of the compressor component and a method for manufacturing the same. According to the embodiment, a vehicle compressor component 1 is, specifically, an impeller 10 as illustrated in FIG. 1.

The compressor component 1 includes an aluminum alloy material made by hot-extruding. The aluminum alloy material for the compressor component 1 has a chemical composition consisting of Fe: 5.0% to 9.0% by mass, Mg: 0.7% to 3.0% by mass, V: 0.1% to 3.0% by mass, Mo: 0.1% to 3.0% by mass, Zr: 0.1% to 2.0% by mass, Ti: 0.02% to 2.0% by mass, and balance Al and unavoidable impurities. The aluminum alloy material has a density of 2.96 g/cm$^3$ or more. The following will describe a detailed configuration of the compressor component 1 according to the embodiment and its manufacturing method.

The aluminum alloy material for the compressor component 1 has a chemical composition consisting of Fe: 8.0% by mass, Mg: 1.0% by mass, V: 2.0% by mass, Mo: 2.0% by mass, Zr: 1.0% by mass, Ti: 0.1% by mass, and balance Al and unavoidable impurities. The aluminum alloy material has a density of 2.96 g/cm$^3$. The density of the aluminum alloy material is obtained by Archimedes method.

To manufacture the compressor component 1, firstly, melted aluminum alloy having an aforementioned chemical composition and a temperature of 1000° C. is prepared. Next, aluminum alloy powders are produced from the melted aluminum alloy by gas atomization, i.e., by blowing gas on the melted aluminum alloy having the chemical composition to prepare fine drops of the melted aluminum alloy, and rapidly cooling and solidifying the fine drops. The mean particle diameter of the aluminum alloy powders is 50 μm, for example.

Figure 2:
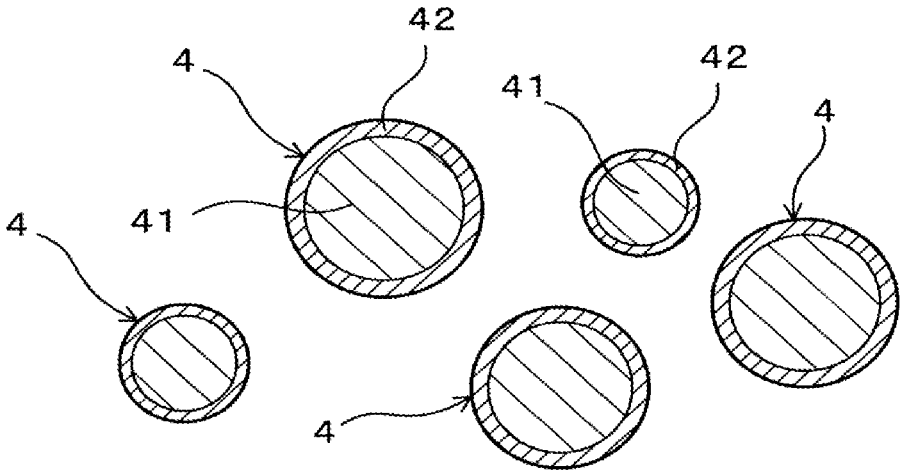
FIG. 2 is a schematic view of aluminum alloy powders used in the embodiment.

The obtained aluminum alloy powders are oxidized by oxygen and the like in the atmosphere during or after solidification of the drops. Accordingly, aluminum alloy particles 4 forming the aluminum alloy powders are considered to each have alloy portion 41 and an oxide film 42 containing oxide of aluminum and formed on the surface of the alloy portion 41, as illustrated in FIG. 2.

The obtained aluminum alloy powders are heated to a temperature of 280° C., and filled into a mold having a temperature of 280° C. Next, the aluminum alloy powders in the mold are compacted at a pressure of 1.5 tf/cm$^2$ (i.e., 145 MPa) to prepare a compact of a solid cylindrical shape having a 210 mm diameter and a 250 mm length. Then, the peripheral surface of the compact ejected from the mold is processed by facing such that the diameter of the compact is reduced to 203 mm.

Next, a die having an 83 mm inner diameter is attached to a container having a 210 mm inner diameter, and the container is heated to a temperature of 400° C. The compact preliminary heated to a temperature of 400° C. is placed in the container. The compact is extruded from the die by indirect-extruding to make the aluminum alloy material.

In the preparation and hot-extruding of the compact, the aluminum alloy powders and the compact are compressed at a high temperature. The alloy portion 41 of the aluminum alloy particle 4 contains Mg, which is more easily oxidized than Al. Accordingly, compressing the aluminum alloy powders and the compact at a high temperature causes Mg to extract oxygen atom from the oxide film 42, thereby promoting reduction reaction of the oxide film 42. This is considered to allow decomposition of the oxide film 42 during compression of the aluminum alloy powders or hot-extruding and therefore facilitates binding of the alloy portions 41.

The obtained aluminum alloy material is processed by lathe machining and cutting machining to obtain the impeller 10 serving as the vehicle compressor component 1 (see FIG. 1). The impeller 10 according to the embodiment has a hub 2 having an approximately circular truncated cone shape and a plurality of blades 3 formed on the peripheral surface of the hub 2. The hub 2 has a through hole 21 formed through the axis of the hub 2. The through hole 21 is formed such that the shaft (not illustrated) of the compressor is inserted in the through hole 21. The impeller 10 is manufactured such that the axis of the hub 2 is parallel to the extrusion direction of the aluminum alloy material.

The specific proof stress, the specific tensile strength, the elongation, and the fatigue strength property of the impeller 10 are evaluated by the following method.

Specific Proof Stress, Specific Tensile Strength, and Elongation

A dumbbell specimen shaped with a 20 mm gauge length and a 4 mm parallel section diameter is taken from the hub 2 of the impeller 10 such that the longitudinal direction of the specimen is perpendicular to the axial direction of the hub 2 (i.e., the extrusion direction of the aluminum alloy material).

The specimen is tested by tension testing specified in JIS Z2241: 2011 at a temperature of 25° C. to obtain a stress-strain curve, and 0.2% proof stress, tensile strength, and elongation are determined from the stress-strain curve. The specific proof stress is obtained by dividing the 0.2% proof stress by the density of the aluminum alloy material, and the specific tensile strength is obtained by dividing the tensile strength by the density of the aluminum alloy material. The specific proof stress, the specific tensile strength, and the elongation obtained by the tension testing are shown in Table 1. The specific proof stress, the specific tensile strength, and the elongation shown in Table 1 are arithmetic mean values obtained from the results of testing a plurality of the specimens.

Fatigue Strength Property

A dumbbell specimen shaped with a 7 mm gauge length and a 4 mm parallel section diameter is taken from the hub 2 of the impeller 10 such that the longitudinal direction of the specimen is perpendicular to the axial direction of the hub 2 (i.e., the extrusion direction of the aluminum alloy material). The specimen is tested by tension and compression fatigue testing specified in JIS Z2273: 1978 at a temperature of 200° C.

The detailed test conditions for the tension and compression fatigue testing are as follows.

Cycle period: 40 Hz

Stress ratio R: −1

Figure 3:
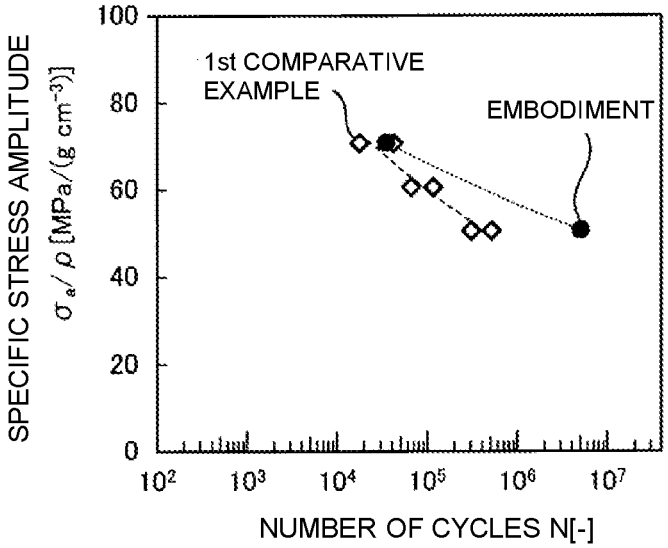
FIG. 3 is a graph depicting S-N curves of the embodiment and a first comparative example.

FIG. 3 shows S-N curves of the specimens. The vertical axis of FIG. 3 represents a specific stress amplitude $\sigma a/\rho$ (unit: MPa/(g/cm$^3$)), and the horizontal axis of FIG. 3 represents the number of cycles N. The horizontal axis indicates logarithmic scale.

First Comparative Example

The following will describe a first comparative example of a vehicle compressor component including an aluminum alloy material without containing Mg. The aluminum alloy material for the compressor component of the first comparative example has the same configuration as that of the compressor component of the embodiment except that the aluminum alloy material for the compressor component of the first comparative example has a chemical composition consisting of Fe: 8.0% by mass, V: 2.0% by mass, Mo: 2.0% by mass, Zr: 1.0% by mass, Ti: 0.1% by mass, and balance Al and unavoidable impurities and the aluminum alloy material has a density of 2.97 g/cm$^3$. The method for manufacturing the compressor component of the first comparative example is the same as that for the compressor component of the embodiment except that the aluminum alloy powders of the compressor component of the first comparative example has the aforementioned chemical composition.

The specific proof stress, the specific tensile strength, the elongation, and the fatigue strength property of an impeller serving as the compressor component of the first comparative example are evaluated by the same method as that for the compressor component of the embodiment. The specific proof stress, the specific tensile strength, and the elongation of the specimens obtained by the tension testing are shown in Table 1. FIG. 3 shows obtained S-N curves of the specimens.

Second Comparative Example

The following will describe a second comparative example of a vehicle compressor component including an aluminum alloy material containing Mg less than that of the aluminum alloy material for the compressor component of the embodiment. The aluminum alloy material for the compressor component of the second comparative example has the same configuration as that of the compressor component of the embodiment except that the aluminum alloy material for the compressor component of the second comparative example has a chemical composition consisting of Fe: 8.0% by mass, Mg: 0.5% by mass, V: 2.0% by mass, Mo: 2.0% by mass, Zr: 1.0% by mass, Ti: 0.1% by mass, and balance Al and unavoidable impurities. The method for manufacturing the compressor component of the second comparative example is the same as that for manufacturing the compressor component of the embodiment except that the aluminum alloy powders of the compressor component of the second comparative example has the aforementioned chemical composition.

The specific proof stress, the specific tensile strength, and the elongation of an impeller serving as the compressor component of the second comparative example are evaluated by the same method as that for the compressor component of the embodiment. Table 1 shows the specific proof stress, the specific tensile strength, and the elongation of the specimens obtained by the tension testing. The compressor component of the second comparative example is not evaluated on fatigue property.

[Table 1]

TABLE 1

| | | Embodiment | First comparative example | Second comparative example |
|---|---|---|---|---|
| Specific proof stress | MPa/(g/cm$^3$) | 146 | 145 | 137 |
| Specific tensile strength | MPa/(g/cm$^3$) | 150 | 155 | 146 |
| Elongation | % | 1.0 | 0.4 | 0.5 |

The comparison among the embodiment, the first comparative example, and the second comparative example in Table 1 shows that the elongation of the compressor component of the embodiment is greater than that of the compressor components of the first comparative example and the second comparative example in the direction perpendicular to the extrusion direction. FIG. 3 shows that the compressor component of the embodiment has fatigue property more excellent than that of the compressor component of the first comparative example because the number of cycles to fracture with the same specific stress on the compressor component of the embodiment is greater than that on the compressor component of the first comparative example.

These results show that the vehicle compressor component including the aluminum alloy material having the chemical composition and the density within the aforementioned special range has excellent elongation and fatigue property.

The details of the vehicle compressor component and the method for manufacturing the same of the present disclosure are not limited to the embodiment, and various modifications may be made within the scope of the gist of the present disclosure. For example, the embodiment illustrates the impeller 10 serving as the compressor component, but any component other than an impeller may serve as the compressor component.

REFERENCE SIGNS LIST

1 vehicle compressor component
10 impeller
2 hub
21 through hole
3 blade

The invention claimed is:

1. A vehicle compressor component comprising: an aluminum alloy material made by hot-extruding, wherein the aluminum alloy material has a chemical composition consisting of Fe: 5.0% to 9.0% by mass, Mg: 0.7% to 3.0% by mass, V: 0.1% to 3.0% by mass, Mo: 0.1% to 3.0% by mass, Zr: 0.1% to 2.0% by mass, Ti: 0.02% to 2.0% by mass, and balance Al and unavoidable impurities, and the aluminum alloy material has a density of 2.96 g/cm$^3$ or more.

2. A method for manufacturing the vehicle compressor component according to claim 1, the method comprising:

compacting aluminum alloy powders having the chemical composition to prepare a compact;

hot-extruding the compact to make an aluminum alloy material; and forming the aluminum alloy material into a desired shape.

* * * * *